US010267131B2

(12) United States Patent
Lecampion et al.

(10) Patent No.: US 10,267,131 B2
(45) Date of Patent: Apr. 23, 2019

(54) COMPETITION BETWEEN TRANSVERSE AND AXIAL HYDRAULIC FRACTURES IN HORIZONTAL WELL

(71) Applicant: Schlumberger Technology Corporation, Sugar Land, TX (US)

(72) Inventors: Brice Lecampion, Cambridge, MA (US); Romain Charles Andre Prioul, Somerville, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 762 days.

(21) Appl. No.: 14/421,469

(22) PCT Filed: Aug. 13, 2013

(86) PCT No.: PCT/US2013/054640
§ 371 (c)(1),
(2) Date: Feb. 13, 2015

(87) PCT Pub. No.: WO2014/028432
PCT Pub. Date: Feb. 20, 2014

(65) Prior Publication Data

US 2015/0218925 A1 Aug. 6, 2015

Related U.S. Application Data

(60) Provisional application No. 61/682,618, filed on Aug. 13, 2012.

(51) Int. Cl.

| | |
|---|---|
| ***E21B 43/11*** | (2006.01) |
| ***E21B 43/26*** | (2006.01) |
| ***E21B 49/00*** | (2006.01) |

(52) U.S. Cl.
CPC ..... *E21B 43/26* (2013.01); *E21B 43/11* (2013.01); *E21B 49/006* (2013.01)

(58) Field of Classification Search
CPC ..... E21B 43/26; E21B 49/006; E21B 41/0092
(Continued)

(56) References Cited

U.S. PATENT DOCUMENTS 4,754,808 A * 7/1988 Harmon ..... E21B 43/2405 166/245
5,065,619 A * 11/1991 Myska ..... E21B 47/06 166/250.07

(Continued)

FOREIGN PATENT DOCUMENTS

| | | | |
|---|---|---|---|
| WO | 2009096805 | A1 | 8/2009 |
| WO | WO2012-054139 | A2 | 4/2012 |
| WO | WO2012097405 | A1 | 7/2012 |

OTHER PUBLICATIONS

International Search Report and Written Opinion for International Application No. PCT/US2013/054640; dated Nov. 6, 2013.

(Continued)

*Primary Examiner* — Jennifer H Gay
(74) *Attorney, Agent, or Firm* — Michael L. Flynn; Rachel E. Greene; Robin Nava

(57) ABSTRACT

An apparatus and methods for forming a transverse fracture in a subterranean formation surrounding a wellbore including measuring a property along the length of the formation surrounding the wellbore, forming a stress profile of the formation, identifying a region of the formation to remove using the stress profile, removing the region with a device in the wellbore, and introducing a fluid into the wellbore, wherein a transverse fracture is more likely to form than if the region was not removed. Some embodiments benefit from computing the energy required to initiate and propa- (Continued)

gate a fracture from the region, optimizing the fluid introduction to minimize the energy required, and optimizing the geometry of the region.

13 Claims, 7 Drawing Sheets

(58) Field of Classification Search
IPC ..... G01V 1/40,1/00
See application file for complete search history.

(56) References Cited

U.S. PATENT DOCUMENTS

| | | | | |
|---|---|---|---|---|
| 5,449,047 | A * | 9/1995 | Schivley, Jr. | E21B 44/00 173/11 |
| 5,482,116 | A | 1/1996 | El-Rabba et al. | |
| 6,876,959 | B1 * | 4/2005 | Peirce | E21B 43/26 702/11 |
| 9,556,720 | B2 * | 1/2017 | Onda | E21B 43/26 |
| 2004/0040708 | A1 * | 3/2004 | Stephenson | C09K 8/805 166/280.1 |
| 2008/0091396 | A1 * | 4/2008 | Kennon | E21B 43/26 703/10 |
| 2008/0183451 | A1 * | 7/2008 | Weng | E21B 43/26 703/10 |
| 2008/0190603 | A1 * | 8/2008 | Brannon | E21B 43/26 166/250.1 |
| 2009/0032255 | A1 * | 2/2009 | Surjaatmadja | E21B 33/13 166/281 |
| 2009/0210160 | A1 | 8/2009 | Suarez-Rivera et al. | |
| 2009/0288833 | A1 * | 11/2009 | Graham | E21B 7/046 166/306 |
| 2011/0259593 | A1 * | 10/2011 | Kostrov | E21B 28/00 166/308.1 |
| 2012/0152548 | A1 | 6/2012 | Hinkel et al. | |
| 2012/0179444 | A1 * | 7/2012 | Ganguly | E21B 43/26 703/10 |
| 2012/0185225 | A1 * | 7/2012 | Onda | E21B 43/26 703/10 |
| 2012/0241152 | A1 * | 9/2012 | Brannon | E21B 43/26 166/280.2 |
| 2013/0140031 | A1 * | 6/2013 | Cohen | E21B 43/26 166/308.1 |
| 2013/0220604 | A1 * | 8/2013 | El-Rabaa | E21B 43/26 166/259 |
| 2014/0182844 | A1 * | 7/2014 | Wutherich | E21B 43/26 166/250.02 |
| 2014/0222405 | A1 * | 8/2014 | Lecerf | G06G 7/50 703/10 |
| 2014/0299315 | A1 * | 10/2014 | Chuprakov | E21B 47/00 166/250.1 |
| 2015/0066453 | A1 * | 3/2015 | Bai | G01V 99/005 703/2 |
| 2015/0075779 | A1 * | 3/2015 | Walters | E21B 49/008 166/250.1 |
| 2015/0233214 | A1 * | 8/2015 | Dusterhoft | E21B 41/0092 703/10 |

OTHER PUBLICATIONS

Office Action issued in Chinese Patent Application No. 201380051349.1 dated Jul. 5, 2016; 17 pages (with English Translation).

* cited by examiner

COMPETITION BETWEEN TRANSVERSE AND AXIAL HYDRAULIC FRACTURES IN HORIZONTAL WELL

PRIORITY

This application claims priority to U.S. Provisional Patent Application No. 61/682,618, filed Aug. 13, 2012. This application is incorporated by reference herein.

FIELD

Methods and apparatus described herein relate to introducing fractures into a subterranean formation and increasing the likelihood that more transverse and less axial fractures form.

BACKGROUND

Most horizontal wells in unconventional reservoirs are drilled in the direction of the minimum stress. The preferred far-field fracture orientation thus favors hydraulic fractures transverse to the wellbore. The near-wellbore stress concentration, however, sometimes favors the initiation of fractures in a plane defined by the well axis. Transverse and axial hydraulic fractures can thus both initiate in some situations and can cause significant near-wellbore tortuosity. The presence of both transverse and axial fractures in the near-wellbore region increases the tortuosity of the flow path within the created fractures and thus, for example, significantly perturb proppant placement.

Most wells in unconventional shale reservoirs are preferably drilled horizontally in the direction of the minimum horizontal stress in order to obtain multiple transverse hydraulic fractures after well stimulation. The cylindrical nature of all wells induces elastic stress concentrations with radial and tangential components that are dependent on borehole fluid pressure in contrast to the axial stress component that is independent of it. Thus, the increase of borehole pressure will eventually generate tensile tangential stresses that may overcome tensile strength and initiate longitudinal fractures (also referred to as axial fractures herein) in a plane defined by the well axis. In contrast, the initiation of a transverse fracture requires the generation of axial tensile stresses from either thermoelastic perturbations, or the pressurization of preexisting natural defects (i.e. cracks), perforations, notches or plug seats. In practice, both transverse and axial hydraulic fractures can initiate from horizontal wells as reported by field observations for both open, cased holes as well as laboratory experiments. When initiated, axial fractures can either reorient themselves to become orthogonal to the minimum stress if they continue to propagate or stop their propagation, depending upon their competition with transverse fractures. The presence of axial or both axial and transverse fractures can lead to higher treating pressures, challenges for proppant placement and increased potential for screenouts. Minimizing axial fractures is therefore of interest for horizontal well stimulation applications.

This problem has been studied using laboratory experiments on hydraulically fractured rock blocks and numerical simulations of fracture initiation pressures based on either a linear elastic strength criteria or a linear elastic fracture mechanics criteria. Each mode of propagation has been studied independently, but the coupled solid-fluid modeling of hydraulic fracture initiation and propagation from a borehole comprising axial and transverse fractures has not been documented.

The most striking field observation of the presence of both axial and transverse fractures in an open horizontal well can be shown on an image log from the Barnett field. FIG. 1 is an image log of a Barnett horizontal well drilled in the direction of the minimum horizontal stress showing fractures in both longitudinal and transverse directions (dark gray). The two longitudinal fractures run along the wellbore at 180 degrees from each other at the top and bottom of the borehole. They are intersected by a series of evenly spaced, small transverse fractures of similar lengths. The background shows shale beddings (lighter gray) as parallel to the wellbore. The horizontal well is drilled in the direction of the minimum principal stress in a field that is known to have a low horizontal stress differential. While the axial fractures have been interpreted as classical drilling-induced fractures from drilling mud pressure variations, the transverse fractures have been interpreted as thermally-induced fractures from the cooling effect due to temperature difference between the drilling mud and the formation. This example highlights the fact that in a low horizontal stress differential environment, small stress perturbations can create axial and transverse fractures originating from the open hole that can serve as seed cracks for future hydraulic fractures. One important missing parameter from such image log observation for hydraulic fracturing considerations is the depth of such fractures away from the borehole wall.

Historically, researchers observed the effect of horizontal stress anisotropy with laboratory experiments using open horizontal wells in cement blocks under polyaxial stress, where low horizontal stress differential mostly led to both transverse and axial fractures as shown in FIG. 2, while high horizontal stress differential mostly favors transverse fractures. The previous observations were moderated when studying the impact of the product of the injection rate and fluid viscosity—at higher injection rates and viscosities, the fractures showed the tendency to initiate along the wellbore, irrespective of the horizontal stress differential. FIG. 2 is a schematic diagram of longitudinal and transverse fractures from a horizontal borehole in low stress anisotropy case. U.S. Pat. No. 7,828,063 provides some additional details and is incorporated by reference herein.

For a cased horizontal wellbore with perforations, it has long been recognized that fractures can initiate as a "starter fracture" at the base of the perforations, then to develop into a "primary" longitudinal fracture of limited length against the intermediate stress, and finally become a "secondary" transverse fracture that initiates at right angle to the longitudinal fracture (FIG. 2). Situations where the borehole is inclined with respect to the principal stresses have also been investigated and lead to the two types of fractures with additional fracture complexities. Experimental studies have also shown that the creation of axial fractures from perforations can be minimized if the perforation interval is less than four times the diameter. Alternative to line or spiral perforations, transverse notches can also be created by jetting tools in order to favor transverse fractures. Notches (also known as cavities) may be created using a perforation device such as the ABRASIJET™ device which is commercially available from the Schlumberger Technology Corporation of Sugar Land, Tex. A perforation device may include an operational device, a perforation tunnel tool, a shaped charge tool, a laser based tool, a radial notching tool, a jetting tool, or a combination thereof. Details for forming a notch (i.e. removing a region of a formation) and using the device are provided in U.S. Pat. No. 7,497,259, which is incorporated by reference herein. Additional details are provided by United States Patent Application Publication Number 2013-0002255 and U.S. patent application Ser. No. 13/402,748. Both of these applications are incorporated by reference herein. Multiple perforations are described in U.S. Provisional Patent Application Ser. No. 61/863,463 which is incorporated by reference herein.

FIG. 3 is a schematic diagram of fractures initiated from perforated cased horizontal borehole and is redrawn from photo of laboratory test on cement blocks under polyaxial stress. This typical fracturing process starts at the base of the perforations, then continues with primary axial fractures and secondary transverse fractures.

Most analysis related to the type of fracture obtained for a particular well orientation and stress field are based on the computation of the stress perturbation around the well and the use of a stress-based tensile failure criteria tailored for defect free open holes, for the effect of perforation tunnels, and for the effect of material anisotropy. Such an approach provides an order of magnitude for the fracture initiation pressure and the most likely type of fractures to be expected (axial or transverse). However, if one or both type of fractures are favored at the borehole wall due to the stress concentration, such a stress analysis does not reveal anything about their extent in the formation. More specifically, depending on the situation, although longitudinal fractures may initiate first, higher energy may be required to propagate them further in the formation compared to transverse fractures. Ways to more effectively estimate and implement fracturing regimes including notch introduction and fluid introduction are needed.

FIGURES

FIG. 6A is a plot using a Barnett formation and FIG. 6B is a plot using a Marcellus formation.

FIG. 7A is a plot using a Haynesville formation and FIG. 7B is a plot using the Case 4 formation.

SUMMARY

Figure 1:
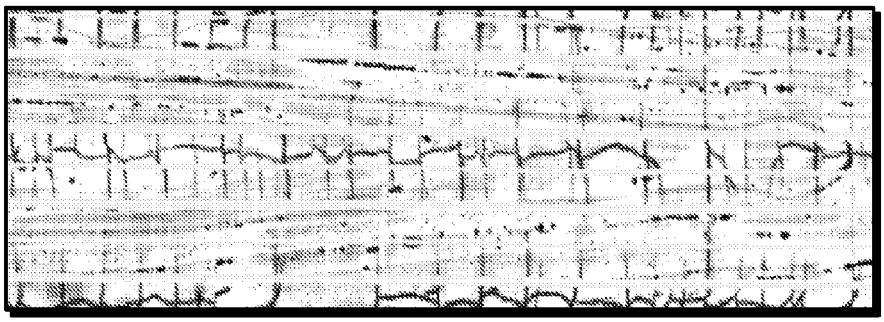
FIG. 1 is an image of a formation with both transverse and axial fractures.
Figure 2:
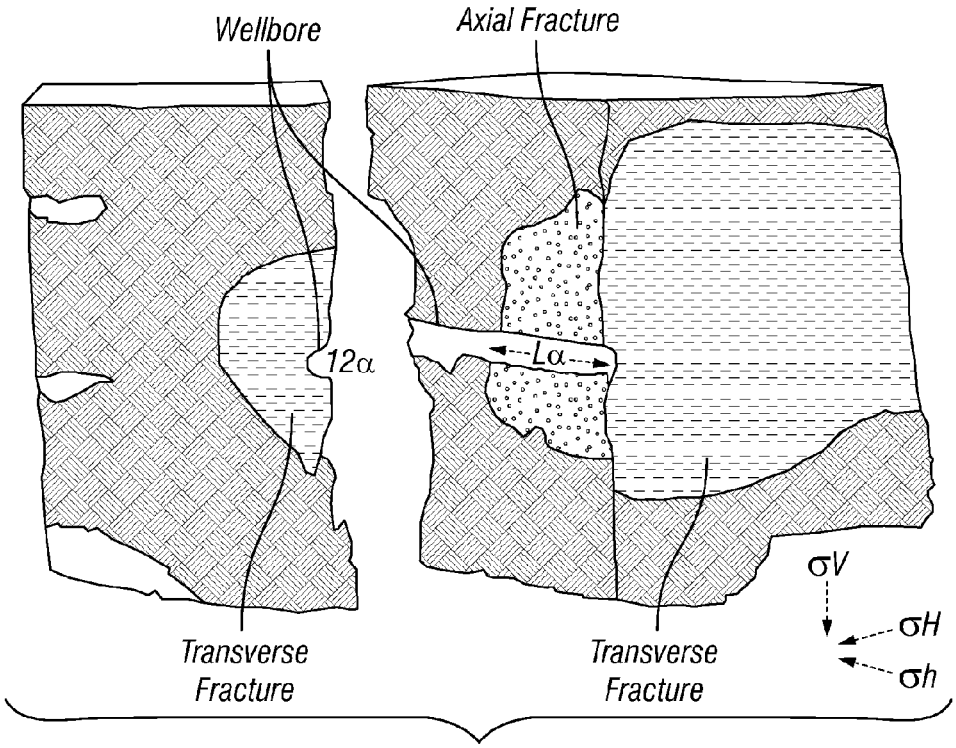
FIG. 2 is a schematic three dimensional diagram of a cement block with both axial and transverse fractures.

Embodiments herein relate to an apparatus and methods for forming a transverse fracture in a subterranean formation surrounding a wellbore including measuring a property along the length of the formation surrounding the wellbore, forming a stress profile of the formation, identifying a region of the formation to remove using the stress profile, removing the region with a device in the wellbore, and introducing a fluid into the wellbore, wherein a transverse fracture is more likely to form than if the region was not removed. Some embodiments benefit from computing the energy required to initiate and propagate a fracture from the region, optimizing the fluid introduction to minimize the energy required, and optimizing the geometry of the region.

DESCRIPTION

Herein, we provide both a methodology and the parameters controlling the occurrence of only transverse or both transverse and axial hydraulic fractures as well as the maximum length of the axial fractures in the latter case. In all cases, the competition between axial and transverse fractures is primarily determined by the initial defects length and the stress field: larger transverse initial defect being preferable in order to favor transverse fractures. The critical seed crack length or notch that favors transverse fractures over longitudinal fractures was observed to be less than one borehole radius in the slow pressurization limit. For realistic injection conditions, if the initial defect length favors longitudinal fractures, the distance over which transverse fractures become energetically favorable can become much larger than the slow pressurization value, especially for large dimensionless viscosity. Smaller pressurization rates and less viscous fluid ultimately favor the propagation of transverse fractures compared to longitudinal ones. In the case of zero horizontal differential stresses, both types of fracture geometries are always possible.

We investigate the competition between these two types of fractures by comparing their energy requirement during hydraulic fracture initiation and propagation. First, we investigate the limiting cases of slow and fast pressurization where fluid flow and fracture mechanics uncouple. We then use numerical models for the initiation and propagation of hydraulic fractures from an open hole accounting for fluid flow in the newly created crack, wellbore stress concentration, and injection system compressibility.

For a given geometry of the region to be removed, borehole geometry, geomechanical properties etc., one can compute the energy required to propagate a fracture on a given path using different numerical or analytical methods (such as the Finite Element Method, the boundary element method, the finite difference methods, the finite volume method or a combination of those).

The energy required to propagate a fracture is defined as the energy required to input in the system in order to create new surface in the material. It depends on the material properties, geometry of the domain (wellbore, cavity removed, propagating fracture) and injection conditions. To obtain the energy required to initiate and propagate a fracture hydraulically, one needs to solve the combined mechanical deformation of the medium combined with the flow of the injected fluid within the region removed and the created fracture.

The total energy input in the system is equal to the flow rate times the injection pressure. Following the results of a computation of the growth of the fracture from a wellbore with a removed cavity under some given injection conditions, one can obtain a plot of the energy input as a function of the created fracture geometry (see for example, FIGS. 7-9 described in more detail below).

Several computation for different geometries of the cavity, injection parameters and fracture paths can then be performed and compared. According to the principle of minimum energy, the fracture path requiring the less input energy will be the one to be created in practice. This series of simulation thus allows one to select the optimal geometry of the cavity to be removed and injection parameters to obtain a pre-defined desired fracture path, based on minimum energy input requirements. The wellbore geometry including the radius, orientation, azimuth, deviation, or a combination thereof may be used in the computations. Also, some embodiments will optimize the geometry of the region to be removed including a length of the region, a width of the region, an angle of the region, or a combination thereof. The angle of the region may be based on a wellbore angle. The region may be tailored based on the radius of the wellbore in some embodiments. The region to be removed is a radial penny-shaped notch or a perforation tunnel or a combination thereof in some embodiments. Some embodiments may have computations that include a geomechanical property of the wellbore such as elasticity, Young and shear moduli, Poisson ratios, fracture toughness, stress field, stress directions, stress regime, stress magnitudes, minimum closure stress, maximum and vertical stress, pore pressure, or a combination thereof.

Figure 3:
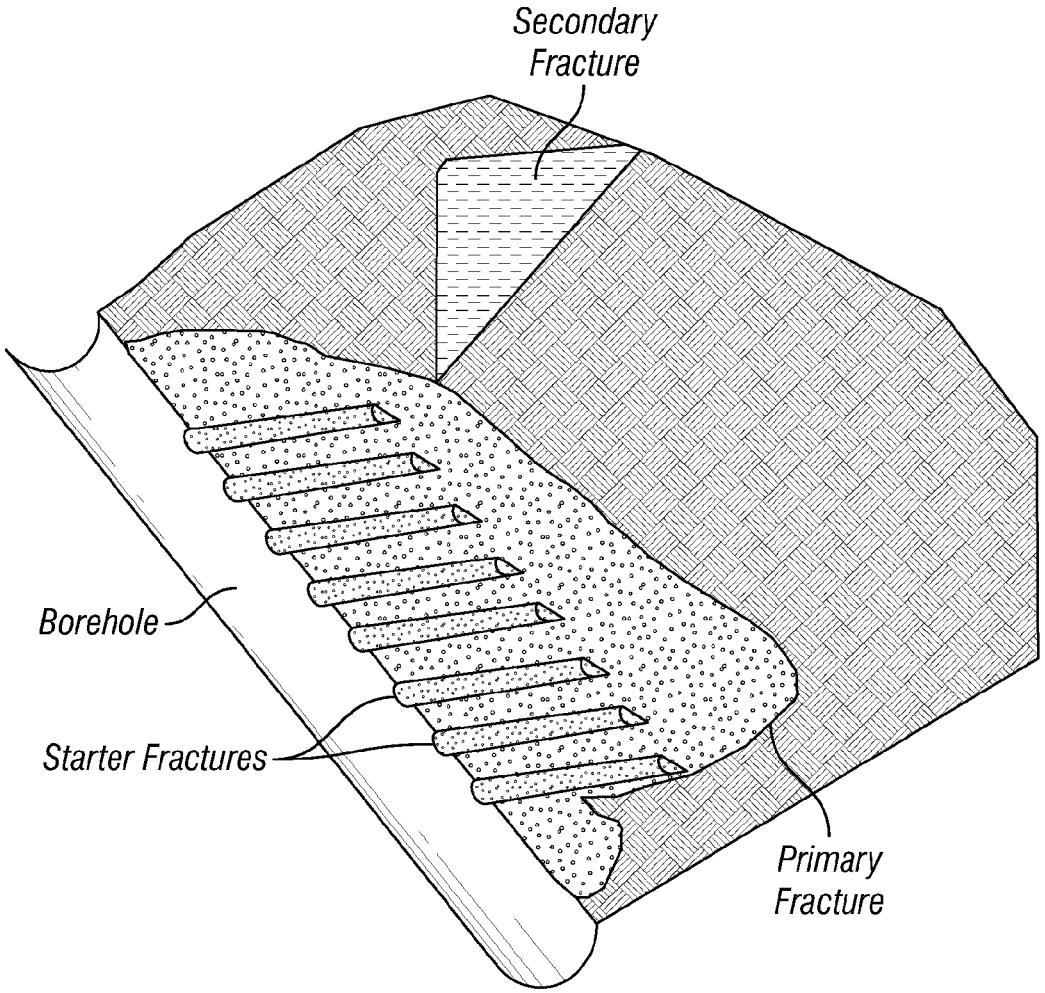
FIG. 3 is a schematic diagram of fractures initiated from perforated cased horizontal borehole.

We use linear elastic fracture mechanics to investigate the further propagation of an initial defect at the borehole wall. We model a horizontal open hole in an elastic medium with a pre-existing crack of a given length that is axial or transverse. We neglect poroelastic effects, which is reasonable for very low permeability rocks including unconventional shales. We do not explicitly consider elastic anisotropy in our formulation. Using the elastic moduli corresponding to the stress normal to the considered fracture is sufficient to account for anisotropy effect to first order because we are studying mode I tensile fractures propagating within principal stress planes. We also neglect thermoelasticity and the presence of perforations for simplicity. The axial fractures are modeled as 2D plane strain fractures and the transverse fractures as 2D axi-symmetric (i.e. radial) fractures, both edging from the wellbore and we fully account for the near-wellbore stress perturbation (see FIG. 3).

A stress analysis, although necessary, does not readily predict the initiation and propagation of hydraulic fractures. Stress analysis, including stress profiles, often include a variety of information to characterize the formation stress. Stress profiles may be formed using information from a mechanical earth model (MEM), geomechanical engineering and data analysis, log data, or wellbore tests including microseismic tests, mini-fracturing observations, and leak-off test results.

To compare these two types of fractures including their energy requirement during hydraulic fracture initiation and propagation, we used numerical models that account for elastic anisotropy, which is relevant for unconventional shale rocks. For a range of relevant formation properties (e.g., elastic anisotropy), far-field stress conditions and stimulation parameters of typical unconventional shale reservoirs, we investigated the length-scale over which the initiation and propagation of axial hydraulic fractures are energetically more efficient than transverse fractures.

Based on dimensional analysis and numerical simulations, we provided a map of the occurrence of these two types of fracture from an open hole as a function of key dimensionless parameters: dimensionless viscosity, normalized differential stress. Both a methodology and the key parameters (fracturing fluid viscosity, fluid pressure, pumping injection rate, wellbore radius, formation in-situ stresses, formation elastic properties and fracture toughness) control the occurrence of only transverse or both transverse and axial hydraulic fractures as well as the maximum length of the axial fractures in the latter case.

We investigated the initiation and early-stage propagation of a hydraulic fracture transverse to a wellbore drilled in an elastic and impermeable formation. Such a configuration is akin to the case of a horizontal well and a hydraulic fracture perpendicular to the well axis. We assume an axi-symmetric fracture, a hypothesis valid at early time before the hydraulic fracture reaches any stress barriers, and focus on open-hole completion. In addition to the effect of the wellbore on the elasticity equation, the effect of the release of the fluid volume stored in the wellbore during the pressurization phase prior to breakdown is also taken into account. Such effect depends on the injection system compressibility (lumping the compressibility of the fluid in the wellbore, tubing etc.). The formulation obviously also account for the strong coupling between the elasticity equation, the fluid flow (lubrication theory) within the newly created crack and the fracture propagation condition. We performed a dimensional analysis of the problem, highlighting the importance of different mechanism at initiation and during propagation. Such an analysis helps to quantify relevant time and length-scales at either the field or laboratory scales. Further, we develop a fully coupled implicit algorithm for the solution of this problem. The hyper-singular elastic boundary equation is discretized using a Displacement Discontinuity Method with the proper elastic kernel including the wellbore effect. The fluid flow is discretized using a simple one-dimensional finite volume method. For a given fracture increment, we solve for the corresponding time-step using the propagation condition. For a given fracture increment and trial time-step, the non-linear system of equations (elasticity and fluid continuity) discretized in terms of opening increment at each nodes is solved via fixed-point iterations. Results are validated via their convergence at large time toward the solution of an axi-symmetric hydraulic fracture in an infinite medium. The effects of the various dimensionless parameters (wellbore radius, viscosity and initial flaw length) on the breakdown pressure, crack propagation and effective flux entering the fracture are investigated below.

Compared to a simple tensile stress analysis, the methodology described here provides a way to quantify the occurrence of only transverse or both transverse and axial hydraulic fractures as well as the maximum length of the axial fractures in the latter case. Based on dimensional analysis and numerical simulations for a range of relevant formation properties and far-field stress conditions, our results show that the critical defect length that favors transverse fracture over longitudinal is less than a borehole radius in the slow pressurization limit. For realistic injection conditions, if the initial defect length favors axial fractures, the distance over which transverse fractures become energetically favorable can become much larger than its slow pressurization value, especially for large dimensionless viscosity. Smaller pressurization rate and less viscous fluid ultimately favor the propagation of transverse fractures compared to axial ones.

Figure 4:
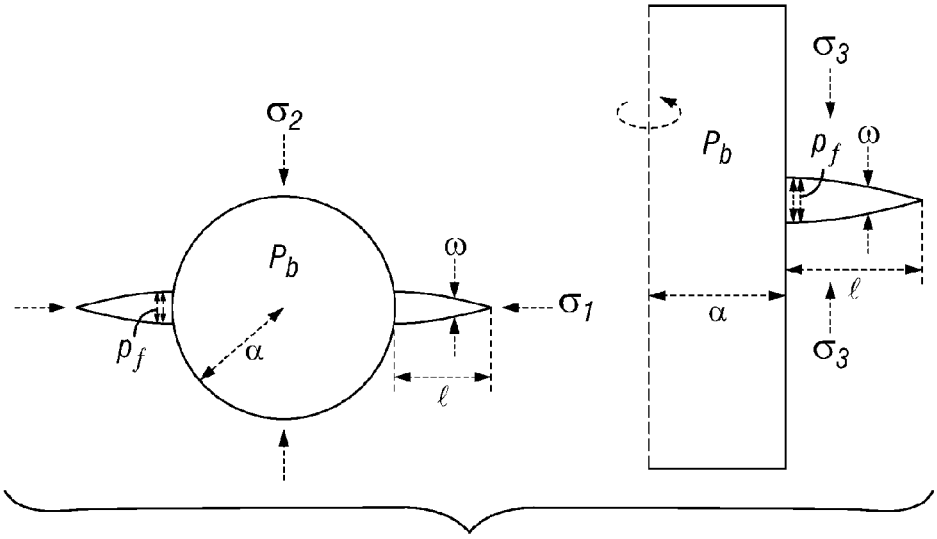
FIG. 4 is a schematic diagram of a longitudinal plane-strain fracture (left), and a transverse fracture modeled as a radial fracture from a wellbore.

Before accounting for the complete effect of borehole pressurization and fracture propagation driven by the injection of a Newtonian fluid on both fracture geometries, we first investigate the case of a slow pressurization where the fluid pressure along the fracture is equal to the wellbore pressure. In order to frame the discussion, we chose four different initial stress fields representative of some unconventional reservoirs: three normal stress regimes with different levels of horizontal stress differential and a strike-slip stress regime (see Table 1, FIG. 4) As already mentioned, we focus on the case of a horizontal well drilled in the direction of the minimum horizontal stress. For such a case in a normal stress regime, both longitudinal and transverse fractures are vertical (ninety degrees to each other). For a strike-slip stress regime, while the transverse fractures remain vertical, the longitudinal ones are horizontal.

TABLE 1

| | Regime | $\frac{\sigma_h}{\sigma_V}$ (−) | $\frac{\sigma_H}{\sigma_V}$ (−) | $\frac{\sigma_h}{\sigma_H}$ (−) | $\frac{P_p}{\sigma_V}$ (−) | $\sigma_V$ (psi/ft) | z (ft) | Relationships |
|---|---|---|---|---|---|---|---|---|
| Case 1 "Barnett" | Normal | **0.6** | 0.6 | 1 | **0.45** | **1.13** | **5,000** | $\sigma_h = \sigma_H < \sigma_V$ |
| Case 2 "Marcellus" | Normal | **0.75** | 0.875 | 0.857 | **0.6** | **1.13** | **6,000** | $\sigma_h > \sigma_H < \sigma_V$ |
| Case 3 "Haynesville" | Normal/ Strike-slip | **0.9** | 1 | 0.9 | **0.8** | **1.13** | **10,000** | $\sigma_h < \sigma_H = \sigma_V$ |
| Case 4a | Strike-slip | **0.9** | 1.5 | 0.6 | **0.45** | **1.13** | **5,000** | $\sigma_h > \sigma_V < \sigma_H$ |
| Case 4b "Undisclosed" | | **0.9** | 1.5 | 0.6 | **0.75** | **1.13** | **5,000** | |

Stress field cases used; values in bold have been chosen approximately based on examples of real unconventional shale plays.

Figure 5:
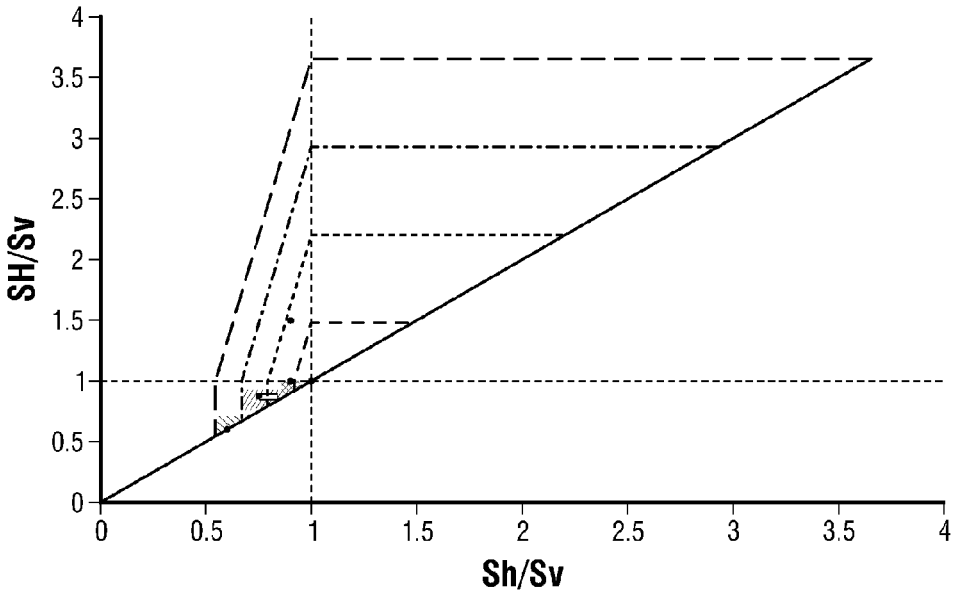
FIG. 5 is a plot of stress with frictional limits over several pore pressures and stress field cases.

FIG. 5 is a Stress Polygon with frictional limits for pore pressures and stress field cases used. The gray patches gives ranges of known stress field for few US shale gas plays from lighter to darker gray level: Fayetteville, Barnett, Marcellus and Haynesville. The dots corresponds to case 1 to 4 (see Table 1).

We use a linear elastic fracture mechanics analysis to compare the initiation of longitudinal and transverse fractures from a wellbore. In the following, we do not explicitly take into account the fluid injection but rather investigate the limiting cases where a defect of a given size $l_o$ edging from the wellbore is either fully pressurized at the wellbore pressure or is pressurized only by the reservoir pressure. The case where the pressure within the fracture is equal to the wellbore pressure corresponds to a slow wellbore pressurization (or, equivalently, the injection of an inviscid fluid) while the case where the fracture is only pressurized by the reservoir fluid corresponds to a fast pressurization where the injected fluid has not yet penetrated into the fracture.

For both longitudinal and transverse fractures, the mode I stress intensity factor for a defect of size $l_o$ edging from the borehole wall is given by:

$$\frac{K_I}{\sqrt{\pi\ell}} = \frac{2}{\pi}\int_0^{\ell_o} p(x+a) f\left(\frac{x}{\ell_o}, \frac{\ell_o}{a}\right) \frac{dx}{\ell_o\sqrt{1-(x/\ell_o)^2}} \tag{1}$$

where p denotes the net pressure acting on the crack, a the wellbore radius and $f(x/l_o, l_o/a)$ is an influence function accounting for the pressure of the wellbore:

$$f(x/\ell_o, \ell_o/a) = \left(\frac{x/\ell_o + a/\ell_o}{1+a/\ell_o}\right)^{d-1}\left(1+0.3\left(1-\frac{x}{\ell_o}\right)\left(\frac{1}{1+\ell_o/a}\right)^4\right)$$

with d=1 for the plane-strain configuration (i.e. longitudinal fracture) and d=2 for an axisymmetric configuration (i.e. transverse fracture). In this notation, the x coordinates denotes the absciss along the crack. The net pressure p is the difference between the fluid pressure $p_f$ in the fracture and the clamping stress $\sigma_o(x)$ normal to the fracture plane due to the far-field stress and the wellbore stress concentration:

$$p(x)=p_f(x)-\sigma_o(x)$$

The clamping stress, in the case of a transverse fracture to a well drilled in the direction of the minimum stress, is equal to the wellbore axial stress and is given by: $\sigma_a=\sigma_h-2\nu(\sigma_v-\sigma_h)\cos\theta$. The wellbore pressure does not affect this axial stress, moreover its azimuthal average is equal to the minimum stress $\sigma_h$. For a first order estimate, we thus take the clamping stress normal to the transverse fracture as uniform and equal to the minimum stress: $\sigma_o=\sigma_h$ for the case of a transverse fracture.

However, for a longitudinal fracture, the wellbore stress concentration has a first order effect on the normal stress to the preferred fracture orientation. From the elastic solution, the clamping stress is equal to the hoop stress $\sigma_{\theta\theta}$ in the direction orthogonal to the intermediate stress (see FIG. 3):

$$\sigma_o(x) = -\frac{a^2}{x^2}p_b + \frac{\sigma_1+\sigma_2}{2}\left(1+\frac{a^2}{x^2}\right) - \frac{\sigma_1-\sigma_2}{2}\left(1+3\frac{a^4}{x^4}\right)$$

where $\sigma_1$ and $\sigma_2$ (with $\sigma_1>\sigma_2$) corresponds to the far-field stress acting in the plane and $p_b$ denotes the wellbore pressure. For a normal stress regime and the case of a horizontal well, $\sigma_1$ is equal to the overburden stress $\sigma_V$ (and $\sigma_2=\sigma_H$) while for a strike-slip regime $\sigma_1$ is equal to $\sigma_H$ (and $\sigma_2=\sigma_V$). Note that the corresponding tensile strength criteria for longitudinal fracture (based on the hoop stress) provides the Hubbert-Willis (H-W) initiation pressure for the case of a fast pressurization: $3\sigma_2-\sigma_1+T-p_o$ and the Haimson-Fairhust (H-F) initiation pressure for slow pressurization $$\frac{1}{2}(3\sigma_2-\sigma_1+T)$$

(when neglecting poroelasticity).

For slow pressurization, the fluid pressure is uniform in the pre-existing defect and equal to the wellbore pressure $p_f(x)=p_b$ while for a fast pressurization it is equal to the reservoir pressure $p_f(x)=p_o$. For a given loading, the initial defect length will propagate if $K_1$ is larger than the rock mode I fracture toughness $K_{Ic}$. Alternatively, for a given fracture toughness and a given defect length $l_o$, we solve for the initiation pressure as the minimum wellbore pressure for which the mode I stress intensity factor reaches the value of the rock fracture toughness. This can be done using a simple root-finding algorithm on equation (1).

Scaling

We scale the defect length and spatial position by the wellbore radius. In doing so, we define a dimensionless fracture length $\gamma$, such that $l=a\gamma$. We scale the stresses and pressure using the critical stress intensity factor and the square root of the characteristic length of the problem: the wellbore radius. We thus define a characteristic pressure/stress $p_*=K'/a^{1/2}$, where $K'=\sqrt{32/\pi}K_{Ic}$ where $K_{Ic}$ is the mode I fracture toughness of the rock (the factor $\sqrt{32/\pi}$ is introduced here to be consistent with usual hydraulic fracturing scalings). Performing such a scaling allows one to compare the effect of the dimensional stress field $\sigma/p_*$ and dimensionless defect length $\gamma_o$ for any value of the rock fracture toughness and wellbore size. The equation for the stress intensity factor can be re-written in dimensionless form as:

$$1 = \frac{2\sqrt{32}}{\pi}\sqrt{\gamma}\int_0^{\gamma}\Pi(1+\xi)f\left(\frac{\xi}{\gamma},\gamma\right)\frac{d\xi}{\gamma\sqrt{1-(\xi/\gamma)^2}}$$

where $\Pi=p/p_*$ is the scaled net pressure.

In the following, we have used a characteristic pressure of 2082 PSI, obtained for a fracture toughness of 1360 PSI. $\sqrt{\text{Inch}}$ and a 8'¾" wellbore diameter.

Slow Pressurization

Figure 6A:
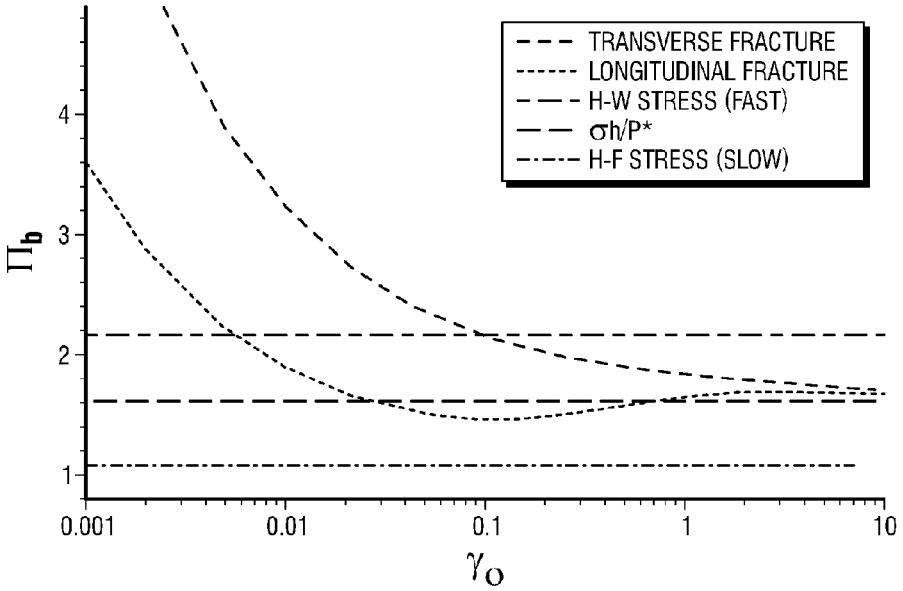
FIGS. 6A and 6B are plots of wellbore initiation pressure as a function of the initial defect length using slow pressurization for both axial and transverse fracture from a horizontal well.
Figure 6B:
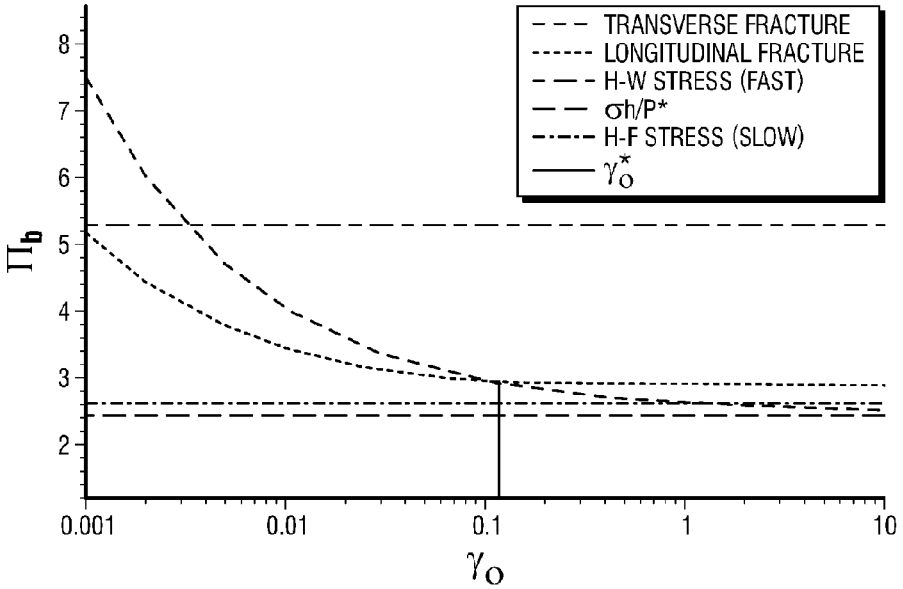

FIG. 6 is a plot of wellbore initiation pressure as a function of the initial defect length (slow pressurization) for both axial and transverse fracture from a horizontal well: Case #1 "Barnett", and case #2 "Marcellus." The stress criteria for the longitudinal fracture (fast and slow) assuming zero tensile strength and the minimum horizontal stress are also displayed.

Figure 7A:
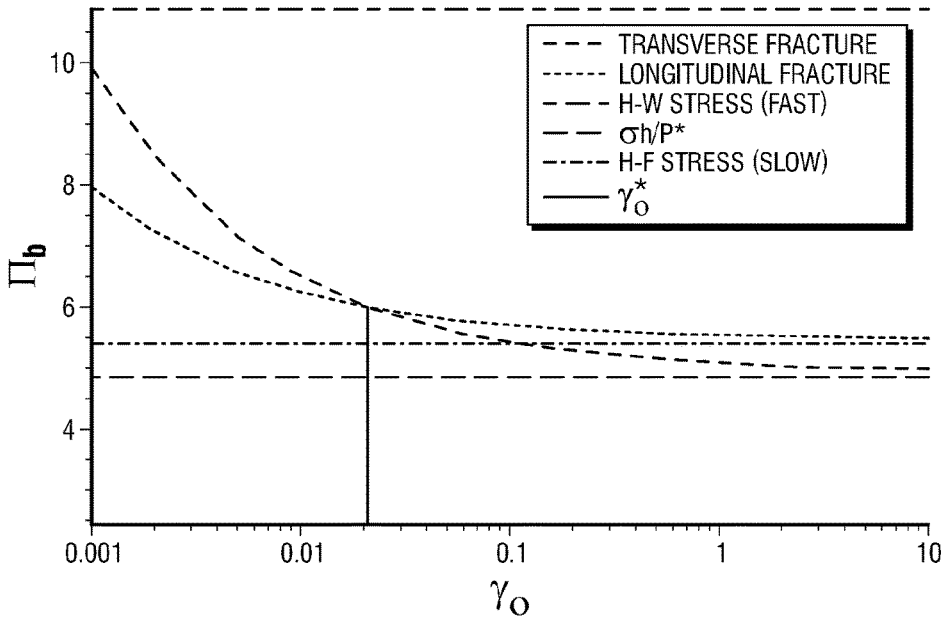
FIGS. 7A and 7B are plots of wellbore initiation pressure as a function of the initial defect length using slow pressurization for both axial and transverse fracture from a horizontal well.
Figure 7B:
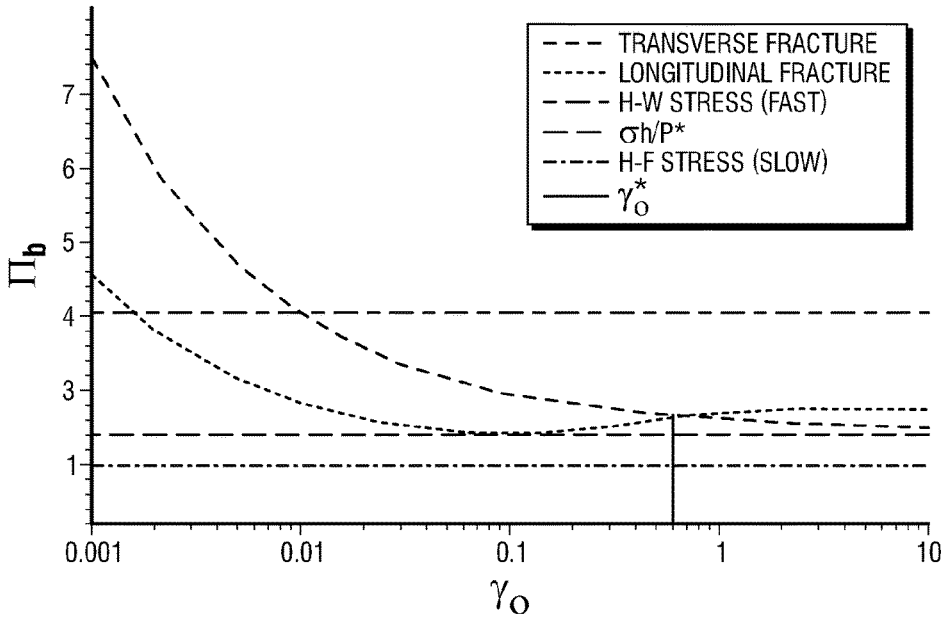

FIG. 7 is a plot of wellbore initiation pressure as a function of the initial defect length (slow pressurization) for both axial and transverse fracture from a horizontal well: Case #3 "Haynesville" and case #4. The stress criteria for the longitudinal fracture (fast and slow) assuming zero tensile strength and the minimum horizontal stress are also displayed.

The dimensionless initiation pressure assuming a slow pressurization as a function of the initial defect length for both the cases of a longitudinal and a transverse fracture are displayed in FIGS. 5 and 6 for the four stress-fields considered here. For reference, we have also shown the scaled minimum horizontal stress as well as the initiation pressure obtained using a stress criteria for longitudinal fractures (Hubbert-Willis and Haimson-Fairhust criteria) assuming a zero tensile strength. For a given defect length, the fracture geometry with the lowest initiation pressure is the most favorable. Due to the effect of the stress concentration, longitudinal fractures are always easier to initiate compared to transverse fracture for small defect length. Depending on the stress field, a cross-over in the most favorable fracture geometry may or may not occur for a given defect length.

We obviously recover the fact that for case #1 (which has no difference in horizontal stresses): axial fractures are always favorable and that for a large defect both types of fractures are possible. These expected results are consistent with numerous field and laboratory observations.

For all the other stress field cases, the transverse fracture becomes more favorable for a dimensionless defect length larger than a critical value $\gamma^*_o$. Such a critical value obviously depends on the stress field. Such a transition from longitudinal to transverse fracture occurs at a smaller value of $\gamma^*_o$ for case #3 than for case #2 and case #4 (strike-slip regime). Note also that for large defect length, the initiation pressure for transverse fractures asymptote toward the minimum horizontal stress.

Fast Pressurization

We observe that for a transverse fracture, a fast pressurization does not load the fracture because i) the fluid does not penetrate into the fracture in the fast pressurization limit and ii) an increase in the wellbore pressure has no effect on the axial stress normal to the transverse fracture. In the limit of a fast pressurization, a transverse defect will not propagate: the fluid needs to penetrate into the defect in order to load it and start its propagation. Consequently, the initiation pressure is infinite for a transverse fracture in the fast pressurization limit.

On the other hand, for a longitudinal fracture, an increase of the wellbore pressure promotes tensile hoop stress. The defect can start to propagate even if no fluid has yet penetrated into it in that case. The initiation pressures for longitudinal fracture in the fast pressurization limit are obviously higher than for the slow pressurization case (typically of about a factor of two).

Influence of the Material Anisotropy

Unconventional shales exhibit elastic anisotropic with transversely isotropic symmetry described by five parameters $E_h$, $E_v$, $v_h$, $v_v$ and $G_v$ for which $E_h/E_v>0$, $v_h/v_v>0$ and $G_v/G_h>0$. The anisotropy affects the stress concentration. It lowers the tensile fracture initiation pressure by lowering the minimum tangential stress. It also lowers the minimum axial stress. Hence, anisotropy can bring both tangential and axial stress concentration closer to the tensile initiation limit and favor the presence of both type of fractures (in a low differential stress field environment).

The analysis performed in this section has highlighted which type of fractures will require the less energy to be initiated depending on both the dimensionless defect length and far-field stresses in the case of the slow pressurization limit. We have also observed that in the fast pressurization limit, longitudinal fractures will always be more favorable than transverse fracture for which the initiation pressure is infinite. Such a fracture mechanics analysis provides greater insight to the competition between both type of fractures compared to a sole tensile stress analysis.

Longitudinal Versus Transverse Hydraulic Fracture Propagation

The analysis performed thus far has neglected the effect of the fluid-solid coupling introduced by fluid flow in the fracture. It is interesting to quantify the effect of a realistic pressurization rate (i.e. between the limiting cases of slow and fast pressurization) on both types of hydraulic fracture geometries. In order to do so, we independently model the initiation and early stage propagation of either transverse and longitudinal fractures from an initial defect of length $l_o$ driven by fluid injection. We account for the complete elasto-hydrodynamic coupling associated with fluid flow and elastic deformation within the fracture as well as the compressibility of the injection system and energy requirements for fracture propagation. We are thus able to investigate the combined effect of injection rate, fluid viscosity, and injection system compressibility. Focusing on the early-stage of propagation in relatively tight rocks like shale gas, we neglect fluid leak-off in the formation. We also restrict the discussion to a Newtonian fluid. However, we do account for the effect of the wellbore stress concentration.

We denote as l(t) the fracture extent: its radius in the case of a transverse fracture, and the size of one of the wings of the fracture in the case of a longitudinal fracture. We denote by w and $p_f$ the fracture opening, fluid pressure respectively. The net pressure, p, is defined as the fluid pressure minus the confining stress normal to the fracture plane. Our aim is to compare the energy input needed to respectively propagate one or the other type of fracture geometry. In other words, we aim to quantify when a given type of fracture is easier to hydraulically propagate over the other one.

We assume a constant injection rate $Q_o$, and a given wellbore pressurization rate prior to breakdown β which is typically about 60 to 100 PSI per second in practice. The compressibility of the injection system U (cubic feet/PSI) results from both the fluid compressibility in the wellbore and surface tubings as well as the "elasticity" of the wellbore and tubing themselves. It is simply related as the ratio between the injection and pressurization rate prior to breakdown: $U=Q_o/\beta$. In order to compare both geometries, we need to account for the extent $L_a$ of the longitudinal hydraulic fracture along the axis of the well which is here modeled using a plane-strain configuration. The flux entering the longitudinal fracture per unit length of its axial extent is thus simply $Q_o/L_a$, while the plane-strain injection compressibility per unit of length is $U/L_a$.

Scaling

Let us first scale the variables governing the propagation of these hydraulic fractures in order to highlight the effect of the different parameters entering the problem (stresses, fluid viscosity, rate etc.). As previously, we scale the fracture length with respect to the wellbore radius a and all stresses and pressure with the characteristic pressure $p_*=K'/a^{1/2}$. While doing so, from the governing equation of the problem, we can obtain the following characteristic fracture width $w_*$ and time-scale $t_*$ while emphasizing for example the importance of fracture energy (Toughness scaling). We write the fracture length, net pressure and fracture width as $l=L_*\gamma$, $p=p_*\Pi$, $w=w_*\Omega$ where γ, Π, Σ and Ω denote the dimensionless fracture extent, net pressure, far-field stress, and fracture opening respectively.

Transverse Hydraulic Fracture

For the case of the radial transverse hydraulic fracture, one obtains the following scales in such a wellbore-toughness scaling (with a superscript T referring to the transverse geometry):

$$L_*^T=a, p_*^T=K'/a^{1/2}, w_*^T=a^{1/2}K'/E', t_*^T=a^{5/2}K'/(E'Q_o) \quad (2)$$

where E' is the plane-strain Young's modulus of the rock formation. The solution of the problem is only dependent, beside the dimensionless far-field stresses $\Sigma=\sigma/p_*$, on two dimensionless parameters: a dimensionless viscosity $M^T$ and a dimensionless system compressibility $U^T$ defined as:

$$M^T = \frac{\mu' E'^3 Q_0}{aK'^4}, \quad U^T = \frac{E'U}{a^3} \quad (3)$$

Longitudinal Hydraulic Fracture

For a longitudinal plane-strain hydraulic fracture of axial extent $L_a$ along the well, the characteristic length, pressure and width scales are similar to that of the transverse fracture but the characteristic time-scale $t_*^L$ is slightly different due to the model geometry. This time-scale $t_*^L$ can be related to the transverse scale via the ratio α between the wellbore radius a and the axial extent $L_a$ of a longitudinal fracture along the wellbore (superscript L refer to the longitudinal fracture):

$$\frac{t_*^L}{t_*^T} = \left(\frac{a}{L_a}\right)^{-1} = \alpha^{-1} \quad (4)$$

The dimensionless viscosity $M^L$ and compressibility $U^L$ in the longitudinal case are also related to their transverse definition as follow:

$$\frac{M^L}{M^T} = \frac{U^L}{U^T} = \frac{a}{L_a} = \alpha \quad (5)$$

In the following, we will discuss our results in the wellbore-toughness scaling of the transverse hydraulic fracture which is defined by Eq. (2)-(3). We will show the effect of different transverse dimensionless viscosity $M^T$ and compressibility $U^T$ as well as initial defect length, far-field stress and the ratio $a/L_a$ on the energy required to propagate the two type of fractures.

TABLE 2

| | 2a (in) | $E_V$ (psi) | $E_H$ (psi) | $\nu_V$ (—) | $\nu_H$ (—) | $K_{Ic}$ (psi$\sqrt{in}$) | $Q_0$ (barrels/min) | β (psi/s) | μ (cp) |
|---|---|---|---|---|---|---|---|---|---|
| Case 1 "Barneu" | 8¾" | 4.0 $10^6$ | 5.4 $10^6$ | 0.19 | 0.21 | 1500 | 20 | 60-80 | 1-100 |
| Case 2 "Marcellus" | 8¾" | 3.1 $10^6$ | 5.4 $10^6$ | 0.17 | 0.26 | 1500 | 20 | 60-80 | 1-100 |
| Case 3 "Haynesville" | 8¾" | 2.8 $10^6$ | 5.2 $10^6$ | 0.17 | 0.25 | 1500 | 20 | 60-80 | 1-100 |
| Cases 4a-b "Undisclosed" | 8¾" | — | — | — | — | 1500 | 20 | 60-80 | 1-100 |

Table 2 summarizes the range of values of the elastic rock properties of the different play investigated as well as typical wellbore size, injection rate (per perforation clusters) and pressurization rate used in the field. From this table, we can obtain a range of values for the dimensionless viscosity and compressibility. First, the dimensionless compressibility is always between $1\times10^6$ and $2\times10^6$. We choose to use a base value of $1\times10^6$. The dimensionless viscosity varies between 30 to 300. In the case of the longitudinal fracture, values for the ratio can be obtained by taking reasonable value of the axial extent along the well $L_a$. Taking $L_a$ as the length of a perforations cluster ($L_a$~3 feet), we obtain a value α≈0.125, while for an extent representative of the spacing between perforation clusters ($L_a$~50-150 feet), we obtain $\alpha \approx 0.005$. We will use these two values of $\alpha$ for comparison. Finally, the initial dimensionless flaw length $l_o/a=\gamma_o$ may vary between 0.01 and 1.00, with a large value being a proxy for the presence of large defects (e.g. perforations in an average sense).

Due to the large value of the dimensionless compressibility resulting from realistic field values, the early stage of hydraulic fracture propagation (up to a dozen times the wellbore radius) is governed mainly by the release of the fluid stored by compressibility during the wellbore pressurization stage. The dimensionless compressibility is typically much lower in laboratory experiments, although it can still control the propagation at the lengthscale of the sample.

Simulations

In order to simulate the initiation and propagation of these two types of hydraulic fractures, we have devised a numerical simulator capable of handling both geometrical configurations: the longitudinal fractures are similar to a bi-wing plane-strain hydraulic fracture, while the transverse hydraulic fracture is akin to a radial hydraulic fracture from a wellbore. The numerical simulator handles in a fully coupled fashion the elasto-hydrodynamic coupling, fracture propagation, wellbore stress concentration and injection system compressibility. The elasticity equation is solved using the displacement discontinuity method using the elastic solution of a dislocation close to a void in the case of a longitudinal fracture, and the elastic solution for a ring dislocation close to a cylindrical wellbore for the transverse case. The lubrication flow is discretized using a finite volume method. An implicit coupled solver is used to equilibrate the fluid flow and elastic deformation while a length control algorithm is used to propagate the fracture.

We compare the power required to propagate these fractures as a function of the dimensionless fracture length with lower energy requirement defining the most favorable fracture geometry. The input power in the system is simply equal to $Q_0 p_b$, where $p_b$ is the wellbore pressure. Restricting to the case of a constant injection rate $Q_0$, the evolution of the energy input is thus similar to the evolution of the dimensionless wellbore pressure $\pi_b$. Note that the characteristic power input $W_*$ is simply $p_* Q_0$ in the scaling used here. We obtain for the same characteristic pressure $p_*$=2082 PSI and an injection rate of 20 barrels per minutes, a characteristic power of about a thousand horsepower for a perforation cluster.

Results

We have performed independently a series of simulations for the transverse and longitudinal hydraulic fractures for different values of dimensionless viscosity ($M^T$=30,300) and initial defect length. We focus in the following on the stress field of cases #1 (no horizontal differential stress) and #4 (strike-slip regime with a large differential stress).

Figure 8:
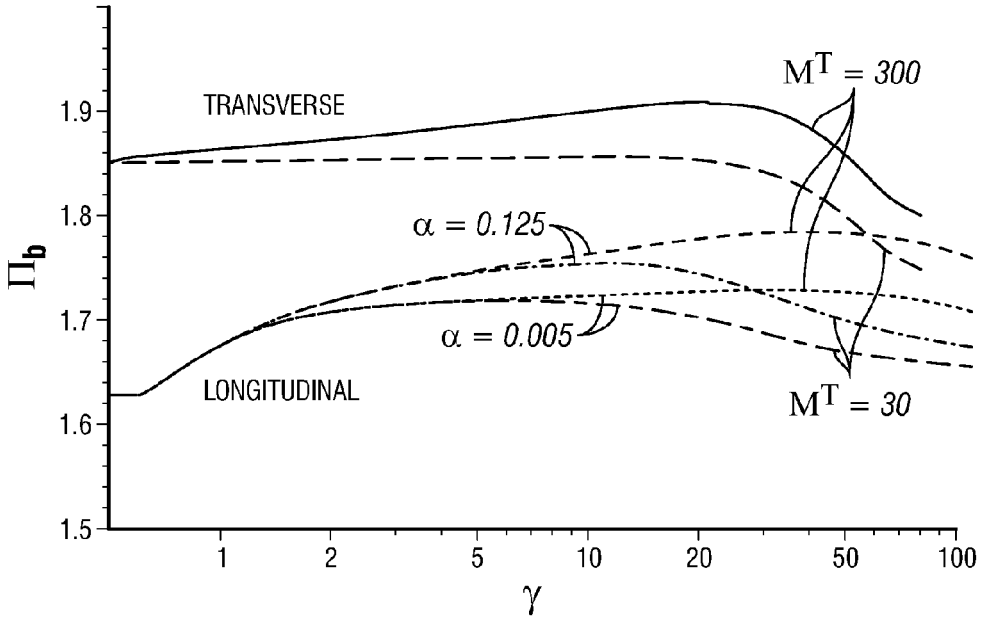
FIG. 8 is a plot of wellbore pressure as a function of hydraulic fracture length for one embodiment.

FIG. 8 displays the wellbore pressure as a function of the fracture length for the case of stress field #1 ("Barnett"), for a high and low dimensionless viscosity. For the longitudinal fracture, the results for two distinct wellbore radii over axial length ratio $\alpha$ are also displayed. An initial defect length $\gamma_o$=0.5 was chosen in these simulations. We can observe that for the same value of dimensionless viscosity, the longitudinal fractures always require less energy to propagate compared with the transverse fracture. Similar results are obtained for smaller initial defect length. It is interesting to point out that longitudinal fracture with larger axial extent (i.e. smaller value of $\alpha$) is also easier to propagate. This is a direct consequence of the plane-strain geometry and the definition of the injection rate per unit length of the fracture as the ratio between the total injected flux divided by the axial extent. Longer axial extent results in smaller longitudinal dimensionless viscosity $M^L=M^T$ and therefore lower viscous forces required for the fluid to pressurize the crack. In all cases, a higher dimensionless viscosity increases the energy requirement for fracture propagation—a common feature in hydraulic fracturing.

The case of stress-field #4 (strike-slip stress regime) is displayed on FIG. 8 for similar values of dimensionless viscosity, and again for an initial defect length of 0.5. For such an initial defect length, the slow pressurization limit is close to the transition where transverse fracture becomes favored compared with the longitudinal fracture. Actually, the numerical evaluation of the stress intensity factor being slightly different compared to the previous section, transverse fractures are initially slightly more favorable in that case and this remains the case as the propagation continues: transverse fractures always require less energy for that case. However, for a smaller initial defect (i.e. $\gamma_o$=0.02), longitudinal fractures, which are initially favored, require more energy than transverse fracture above a given fracture length as can be seen on FIG. 10. This transition toward more favorable transverse fractures is intrinsically embedded in the stress field, but the length over which it happens is governed by the initial defect length, dimensionless viscosity and compressibility. Higher dimensionless viscosity delays such a transition toward transverse fracture. It is also important to note that for the cases presented here, the fracture length at which the transverse fracture becomes more favorable is relatively large (more than thirty time the wellbore radius). The hypothesis of the fracture geometries (radial and plane-strain) might become questionable if a stress or lithological barrier is encountered at such a scale.

Figure 9:
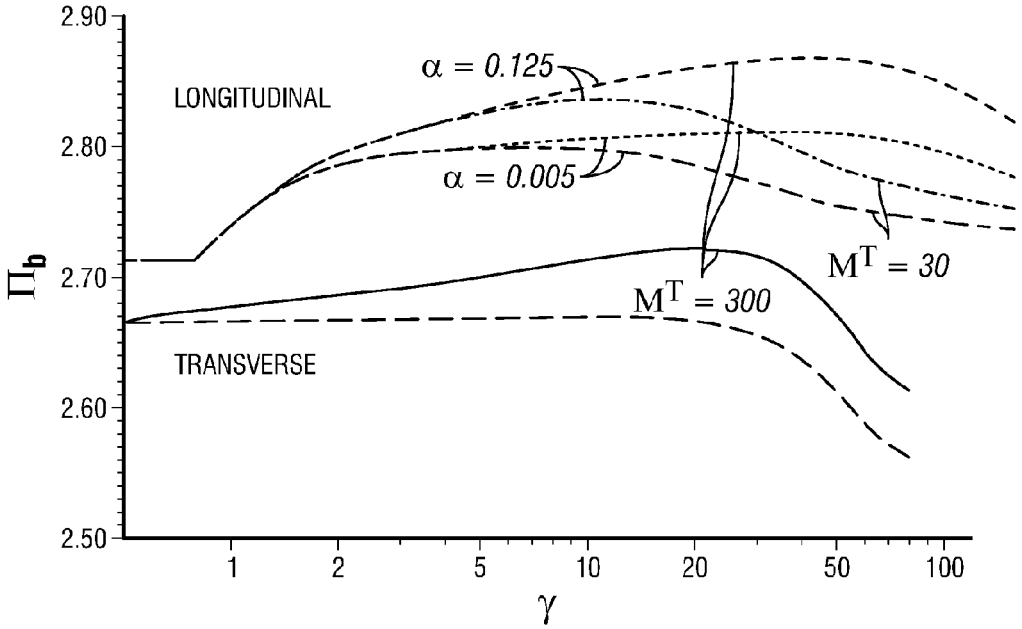
FIG. 9 is a plot of wellbore pressure as a function of hydraulic fracture length for another embodiment.
Figure 10:
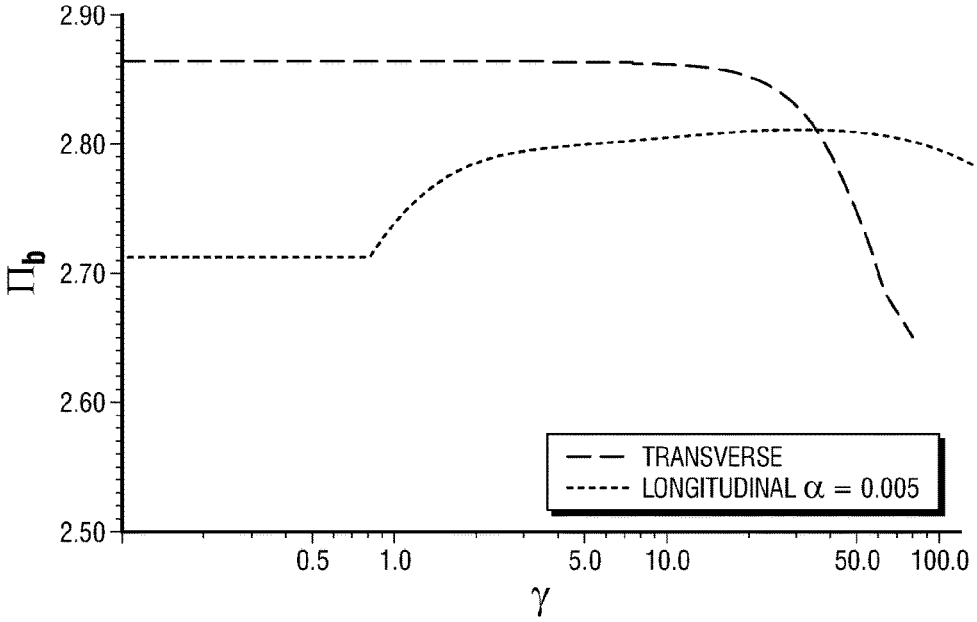
FIG. 10 is a plot of wellbore pressure as a function of hydraulic fracture length.
Figure 11:
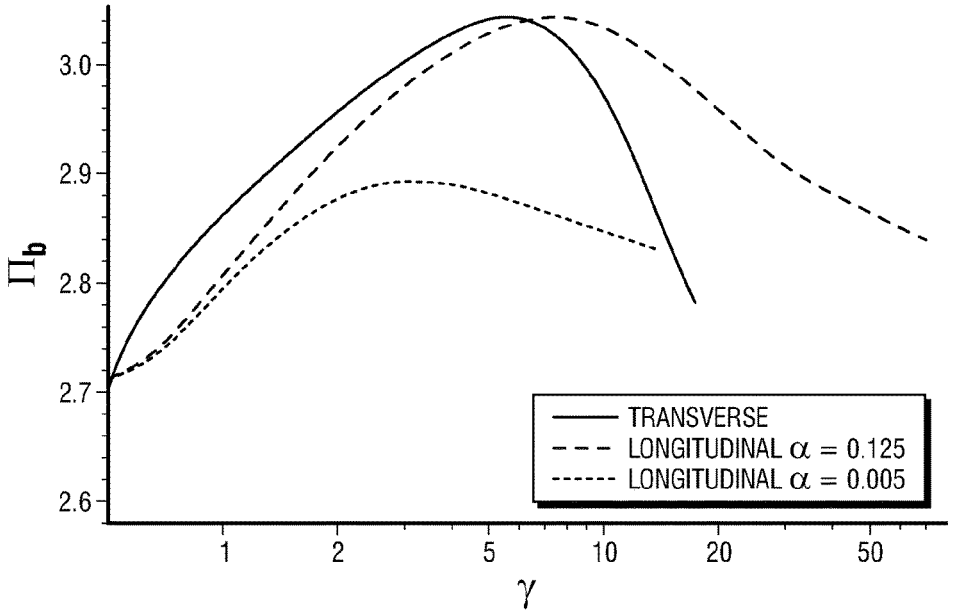
FIG. 11 is a plot of wellbore pressure as a function of hydraulic fracture length.

Plotting the wellbore pressure as a function of hydraulic fracture length illustrates this. FIG. 8 is a plot of wellbore pressure (i.e. power input) as a function of hydraulic fracture length—Case #1 stress-field. Effect of dimensionless viscosity $M^T$ and axial extent (longitudinal fracture only), $U^T=10^6$, initial defect length of 0.5. Also, FIG. 9 is a plot of wellbore pressure (i.e. power input) as a function of hydraulic fracture length—Case #4 stress-field. Effect of dimensionless viscosity $M^T$ and axial extent (longitudinal fracture only), $U^T=10^6$, initial defect length of 0.5. FIG. 10 is a plot of wellbore pressure (i.e. power input) as a function of hydraulic fracture length—Case #4 stress-field. $M^T$=30 and axial extent $\alpha$=0.005 (longitudinal fracture only), $U^T=10^6$, initial defect length of 0.02. Finally, FIG. 11 is a plot of wellbore pressure (i.e. power input) as a function of hydraulic fracture length—Case #4 stress-field. Impact of a lower system compressibility $U^T=10^4$; dimensionless viscosity $M^T$=30, initial defect length of 0.5.

Finally, it is interesting to investigate the effect that a smaller value of the dimensionless system compressibility may have on the competition between axial and transverse fractures. A smaller value corresponds to a larger pressurization rate (for the same injection rate). For stress-field #4, a dimensionless viscosity of 300 and compressibility of $U^T=10^4$ (more similar to a laboratory scale experiment), we can see from FIG. 10 that longitudinal fractures become easier to propagate although the energy for a transverse fracture was initially slightly lower. Such an effect of system compressibility/pressurization rate has been observed experimentally. In a given stress field, both transverse and axial hydraulic fractures were created at large rate while only transverse fracture were observed for low rate. This observation is also qualitatively explained by the difference between the fast and slow pressurization limit, where longitudinal fractures always require less energy in the fast pressurization case. In field applications, it is unlikely that such a transition (from transverse fracture to longitudinal fracture) occurs because of the larger value of the system compressibility. We have never observed in our simulations a transition from an initially favored transverse fracture back to a more favorable longitudinal fracture for larger fracture length with a dimensionless system compressibility presentative of field conditions. Such an effect of the system compressibility should be kept in mind when analyzing laboratory tests that may not strictly represent field conditions.

The assumption of slow pressurization is a good way to grasp the competition between the initiation of the two types of fracture geometries for a given stress field. However, by accounting for the complete fluid-solid coupling, we have seen that both dimensionless viscosity and injection system compressibility may delay the transition toward transverse fractures (larger viscosity) or, for a low system compressibility (although more akin to a laboratory setting than field conditions), it may even promote axial fractures in a situation otherwise favorable to transverse ones.

In practical terms, our study confirms field experiences that the creation of a radial notch is the best way to favor transverse fractures. The benefit here includes combining the advantages of radial notches with the practical constraints of multi-stage fracturing.

The invention claimed is:

1. A method for forming a transverse fracture in a subterranean formation surrounding a wellbore, comprising:

measuring a property of the formation surrounding the wellbore, the wellbore defining a radius;

forming a stress profile of the formation;

identifying a region of the formation to remove using the formed stress profile;

selecting an optimal geometry of the region to be removed by a length of the region, a width of the region, an angle of the region, or a combination thereof by performing and comparing a plurality of computations for different geometries, injection parameters, and fracture paths;

removing the region with a device in the wellbore based on the selected optimal geometry and thereby forming a notch, the notch having a length of greater than zero and less than one wellbore radius; and introducing a fluid into the wellbore, wherein the notch favors the formation of a transverse fracture when the fluid is introduced into the wellbore.

2. The method of claim 1, wherein the identifying comprises computing the energy required to initiate and propagate a fracture from the region.

3. The method of claim 2, further comprising optimizing the fluid introduction to minimize the energy required.

4. The method of claim 1, further comprising selecting the angle of the region based on a wellbore angle.

5. The method of claim 1, wherein the notch is a radial notch or a perforation tunnel or a combination thereof.

6. The method of claim 1, wherein the introducing the fluid is selected from the group consisting of a viscosity, a pressure of the fluid, a pumping injection rate or a combination thereof.

7. The method of claim 1, wherein the identifying comprises using the wellbore geometry.

8. The method of claim 7, wherein the geometry is selected from the group consisting of the radius, orientation, azimuth, deviation, or a combination thereof.

9. The method of claim 1, wherein the property comprises a geomechanical property of the wellbore.

10. The method of claim 9, wherein the geomechanical property is selected from the group consisting of elasticity, Young and shear moduli, Poisson ratios, fracture toughness, stress field, stress directions, stress regime, stress magnitudes, minimum closure stress, maximum and vertical stress, pore pressure, or a combination thereof.

11. The method of claim 1, wherein the device is a perforating device.

12. The method of claim 11, wherein the device is selected from the group consisting of an operational device, a perforation tunnel tool, a shaped charge tool, a laser based tool, a radial notching tool, a jetting tool, or a combination thereof.

13. The method of claim 1, wherein selecting an optimal geometry further comprises selecting the geometry based on minimum energy input requirements.

* * * * *